US009247610B2

(12) United States Patent
Baret

(10) Patent No.: US 9,247,610 B2
(45) Date of Patent: Jan. 26, 2016

(54) PROGRAMMABLE LED LIGHTING DEVICE AND METHOD

(75) Inventor: Emmanuel Baret, Marseilles (FR)

(73) Assignee: BRIGHT IN RESEARCH & DEVELOPMENT (SARL), Neuilly sur Seine (FR)

( * ) Notice: Subject to any disclaimer, the term of this patent is extended or adjusted under 35 U.S.C. 154(b) by 159 days.

(21) Appl. No.: 14/009,481

(22) PCT Filed: Apr. 5, 2012

(86) PCT No.: PCT/FR2012/000130

§ 371 (c)(1),
(2), (4) Date: Dec. 17, 2013

(87) PCT Pub. No.: WO2012/136907

PCT Pub. Date: Oct. 11, 2012

(65) Prior Publication Data

US 2014/0210373 A1 Jul. 31, 2014

(30) Foreign Application Priority Data

Apr. 6, 2011 (FR) ..... 11 01036

(51) Int. Cl.
*G05F 1/00* (2006.01)
*H05B 33/08* (2006.01)
*H05B 37/02* (2006.01)

(52) U.S. Cl.
CPC ..... *H05B 33/086* (2013.01); *H05B 37/0263* (2013.01); *H05B 37/0272* (2013.01)

(58) Field of Classification Search
CPC ..... H05B 33/086; H05B 33/0815; H05B 37/029; H05B 37/0254
USPC ..... 315/294, 291, 308, 307, 313, 322, 323, 315/362; 362/293, 35, 101, 267, 310, 364
See application file for complete search history.

(56) References Cited

U.S. PATENT DOCUMENTS 5,107,184 A * 4/1992 Hu et al. ..... 315/291
6,333,605 B1 * 12/2001 Grouev et al. ..... 315/291
2002/0163316 A1 * 11/2002 Lys ..... H05B 37/0263 315/291
2008/0157939 A1 * 7/2008 Sutardja ..... 340/310.12

* cited by examiner

*Primary Examiner* — Lincoln Donovan
*Assistant Examiner* — Thomas Skibinski
(74) *Attorney, Agent, or Firm* — Egbert Law Offices, PLLC

(57) ABSTRACT

The invention relates to a lighting device and method, in particular underwater, including: a plurality of spotlights comprising at least one light source nude up of a set of LEDs, the spotlights being connected to an electric power source; and at least one control housing connected to said power source and communicating with each one of the spotlights, said control housing being provided with a cut-off device configured to transmit control instructions via a power cut-off member to the spotlights, which are provided with an on-board detector having a microprocessor configured such as to interpret said control instructions and to adjust a signal capable of modifying the color of each one of the LEDs that make up the set of LEDs, characterised in that the control instructions transmitted by the cut-off device are transmitted in the form of a code made up of combinations of power cut-offs with various durations.

16 Claims, 4 Drawing Sheets

PROGRAMMABLE LED LIGHTING DEVICE AND METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention concerns a programmable LED lighting device and method.

The present invention concerns the field of lighting, in particular in aquatic environments. Advantageously, it aims at a lighting device featuring one or several submersible devices, also called underwater spotlights, usable for lighting swimming pools and their immediate surroundings (beach, terraces, gardens . . . ). It applies also to the lighting of fountains, spas or other locations, as well as to lighting in the air.

2. Description of Related Art including Information Disclosed Under 37 CFR 1.97 and 7 CFR 1.98

Immerged spotlights or underwater spotlights for lighting swimming pools are widely used today to illuminate the water of the basins and their surroundings at nightfall, in order to securitize the place and to provide an esthetic rendering. More precisely, the invention applies to spotlights utilizing the technology of light-emitting diodes known as LEDs which contain a number of LEDs of intense brightness (see for example documents EP-1.840.450, EP-1.460.333).

These underwater LED spotlights are very economical. They consume very small amounts of energy (only a few Watts) and last for a very long time (more than 10 years in daily use). LEDs are also sturdier, have a longer useful life than incandescent light bulbs or fluorescent lights and have a payoff three to four times greater than those.

Evolution of LED technology has led to the emergence of spotlights offering the possibility to generate light of different colors or lighting sequences in various colors. Most often, installations using such spotlights are configured for making changes, in a controlled way by remote control. The color mix and the variation of transition speeds offer, as a rule, a very wide choice of tints and operating modes.

However, this choice is limited by the difficulty of remotely controlling, and in a synchronized fashion, the changes of the operating mode, particularly when the installation features several spotlights as is the case, for example, in applications for lighting swimming pools.

Remote control of color changes can be done by transmitting information over radio-electric waves or over wires or also by using a power cable as transmission support (broadband over power line (BPL), see for example document FR-2.931.925. These transmission devices require that the spotlights be equipped with a receiver which proves to be complex and costly, especially for residential applications.

Various solutions exist to change the color of LEDs. The US-2002/0A 63.316 document describes, for example, a device whereby a rapid power cut to the LEDs is provoked. These systems are equipped with a detection device to detect the cut which authorizes the color change, and this, thanks to the energy generally accumulated in condensers that come with the spotlight. Such operations can only occur when a switch is activated in order to cause a rapid power cut which must be neither too short nor too long so that the energy accumulated in the spotlights is able to maintain the power supply of the detection device during the duration of the power cut. On the other hand, the color change occurs through incrementation and according to a predefined order. That is to say, for a spotlight capable of emitting ten (10) different colors, it is necessary, successively, to carry out nine (9) power cuts in order to select the last color, and to make successively ten (10) cuts to return to the previous color. The drawback of this process is that one cannot choose and obtain directly and instantly the desired color. Furthermore, each power cut is of a different length so as to be interpreted by the device as a unique and complete information, therefore the lengths of the cuts must be neither too short nor too long, making the process much too limiting because of a restricted vocabulary. In effect, a cut of too short duration could be assimilated to an unwanted signal, thus creating the possibility of desynchronizing the spotlights which happens when they do not detect the cut, and a cut of too long duration could be assimilated to a power cut because of too long response time and could lead to the extinction of the spotlights.

Objective of the Invention

The aim of the invention is in particular to remedy the drawbacks of prior art, especially the disadvantages resulting from the implementation of the devices described above.

Another objective of the present invention is to propose a method and a lighting device that can receive and interpret a code intended to change the operating mode of the spotlights which is relatively simple and inexpensive.

Another objective is to propose a method and a device making it possible to instantly and easily obtain the color change of the spotlights.

BRIEF SUMMARY OF THE INVENTION

These objectives, as well as others that will appear later on, have been attained thanks to a lighting device, in particular an underwater lighting device comprising a number of spotlights, each featuring at least one light source constituted by a set of LEDs capable of emitting light of different colors, said plurality of spotlights being connected to an electric power source, and at least one control box connected to said power source. The control box is equipped with an interrupting device capable of transmitting, over a current disconnect advantageously constituted by a relay or a triac, command instructions to the spotlights in the form of successions of short and long power cuts. The spotlights are equipped with an embedded detector which has a microprocessor suitable or configured for interpreting said commands and to modulate a signal capable of modifying the color of each of the LEDs in an LED set. This device is remarkable in that the commands emitted by the interrupting device of the control box are transmitted in the form of a code consisting of combinations of short and long power cuts.

According to an advantageous characteristic arrangement of the invention, the light source is constituted by a set of LEDs where each LED is capable of emitting a single color.

According to another advantageous arrangement, the light source is constituted by LEDs of different colors with each LED being capable of emitting several colors, these LEDS being for example RGB LEDs.

According to another characteristic arrangement of the invention, the control box is provided with keys for selecting an operating mode associated with a command transmitted in the form of combinations of power cuts.

According to another characteristic arrangement of the invention, the control box includes a microprocessor coupled to a time base capable of creating power cuts of precise duration.

According to an interesting characteristic of the invention, the interrupting device, and more precisely, the microprocessor is configured to generate combinations of m short and long power cuts.

Advantageously, the power cuts last between 100 and 300 ms for a so-called "short" cut and between 300 and 500 ms for a so-called "long" cut.

According to an advantageous characteristic of the invention, the device includes a remote control for wireless communication with the control box, the latter being equipped with a radio wave receiver constituted by an antenna.

According to yet another advantageous characteristic of the invention, the microprocessor of the embedded detector includes a program featuring the different operating modes so as to interpret said commands transmitted by the microprocessor of the emitter and to modulate a signal capable of modifying the color of each of the LEDs making up the LED set.

The invention concerns also a lighting method, in particular of underwater lighting of the kind comprising a plurality of spotlights each featuring at least one light source constituted by a set of LEDs capable of emitting lights of different colors, said plurality of spotlights being connected to an electric power source; and at least one control box connected to said power source and communicating with each of the spotlights.

According to the method of the invention, the control box is configured to generate a code constituted by short and long power cuts or by combinations of such cuts, and to transmit commands capable of modifying the color of each of the LEDs making up the LED set, and the spotlights are equipped with embedded detectors provided with a microprocessor capable of interpreting said commands transmitted by the control box in the form of a succession of power cuts.

An operating mode of the spotlight is selected by means of the keys of the control box, said operating modes being associated with commands.

According to another arrangement of the method of the invention, the power cuts generated by the control box are detected and then duration is measured by the detector of the spotlights equipped with a microprocessor which interprets said code constituted by all the cuts, and modulates a signal intended to modify the operating mode of the spotlights.

According to another interesting characteristic of this method, the microprocessor generates combinations of m short and long power cuts.

Advantageously, the microprocessor of the embedded detector is programmed with the different operating modes of the spotlights so as to interpret said commands transmitted by the microprocessor of the emitter and to modulate a signal capable of modifying the color of each of the LEDs in the LED assembly.

BRIEF DESCRIPTION OF THE DRAWINGS

The above-cited aims, characteristics and advantages, and still more, will become clearer from the following detailed description and the attached drawings in which.

DETAILED DESCRIPTION OF THE INVENTION

Reference is made to said drawings to describe interesting, although by no means limiting examples of implementation of the lighting device 1, in particular of an underwater lighting device 1.

Figure 1:
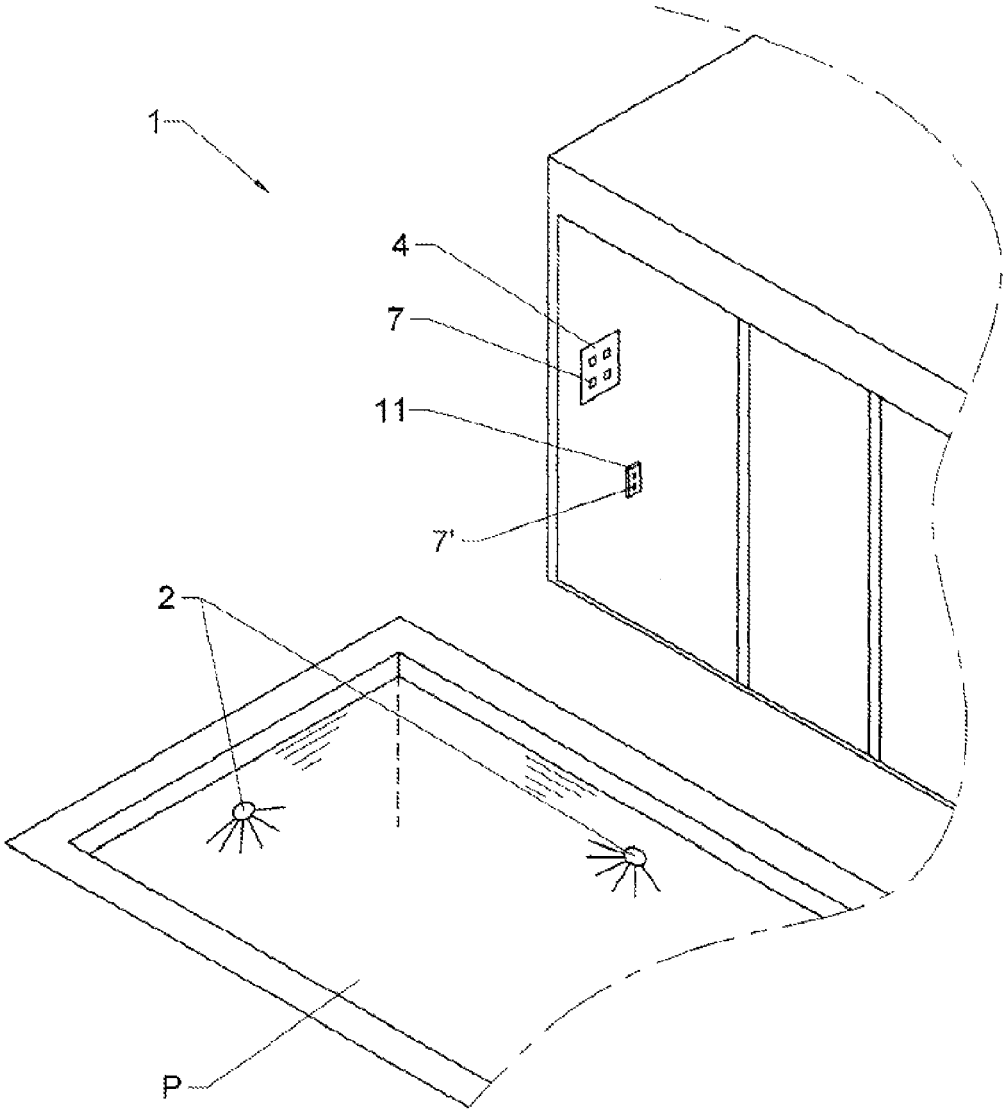
FIG. 1 is a schematic view in perspective of an installation equipped with the lighting device according to the invention.
Figure 2:
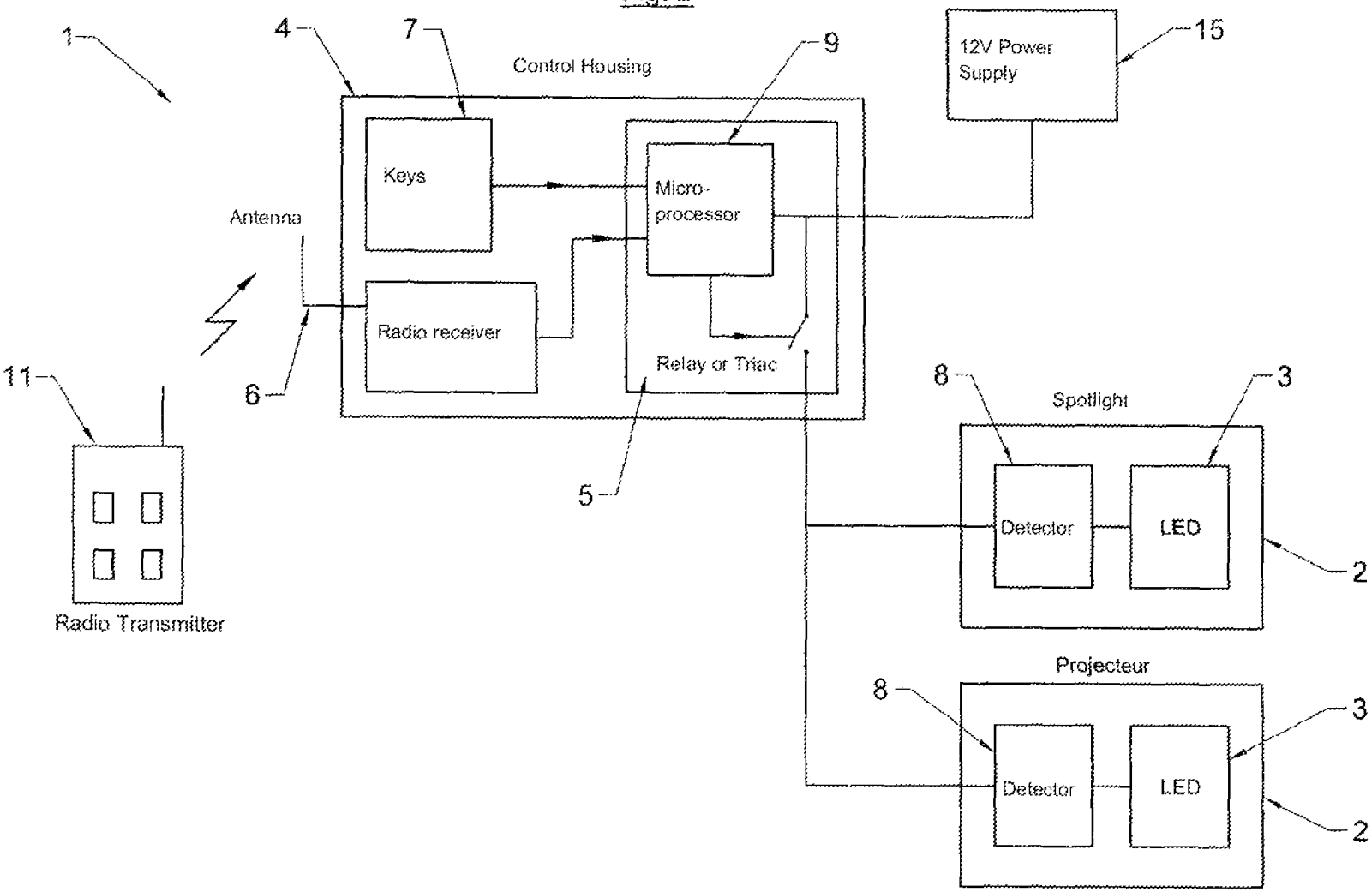
FIG. 2 is a schematic view of a diagram illustrating the operating principle of the invention.
Figure 3:
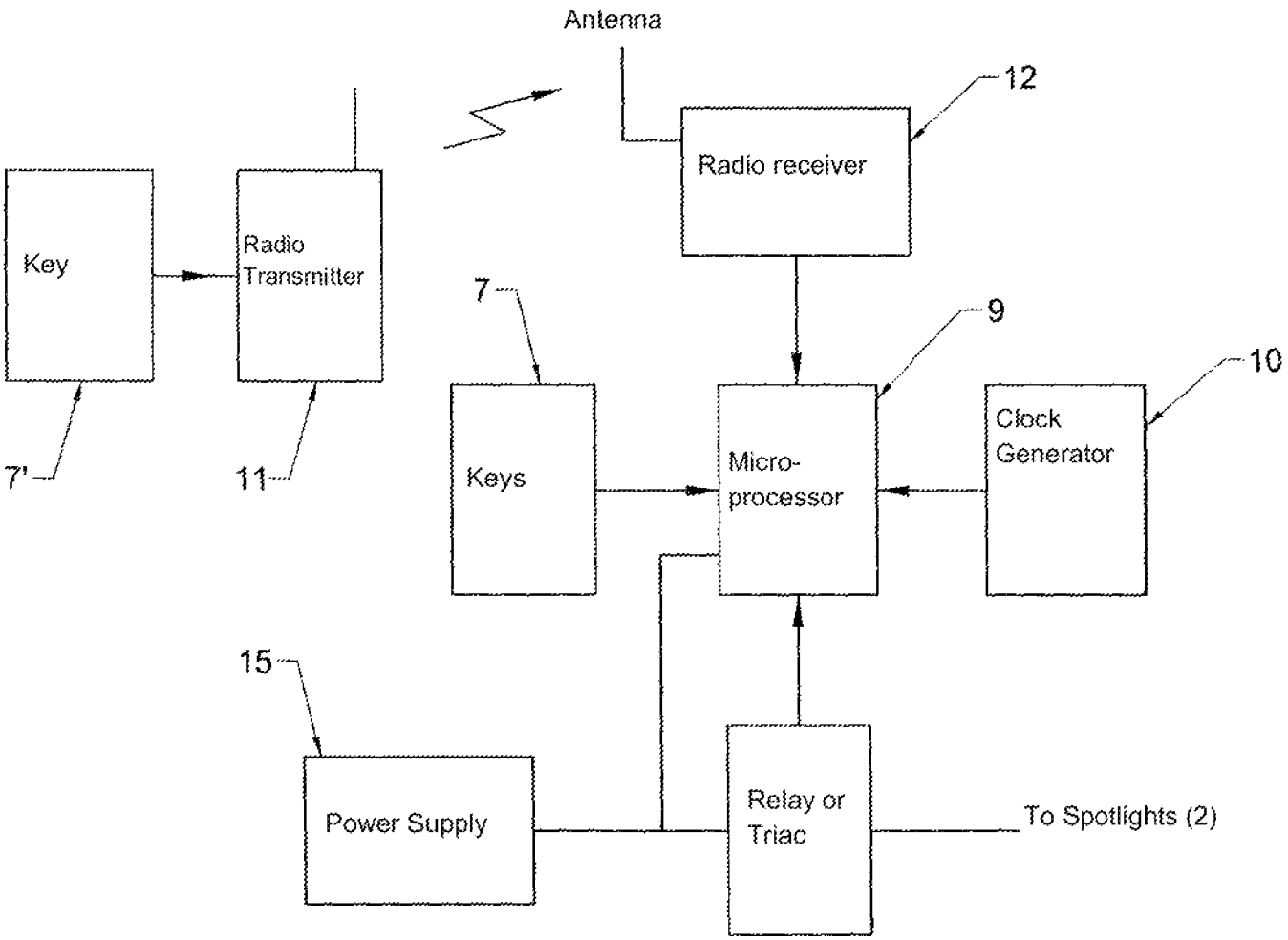
FIG. 3 is a schematic illustration of the operating principle of the circuit of an emitter installed in the control box, according to the invention.
Figure 4:
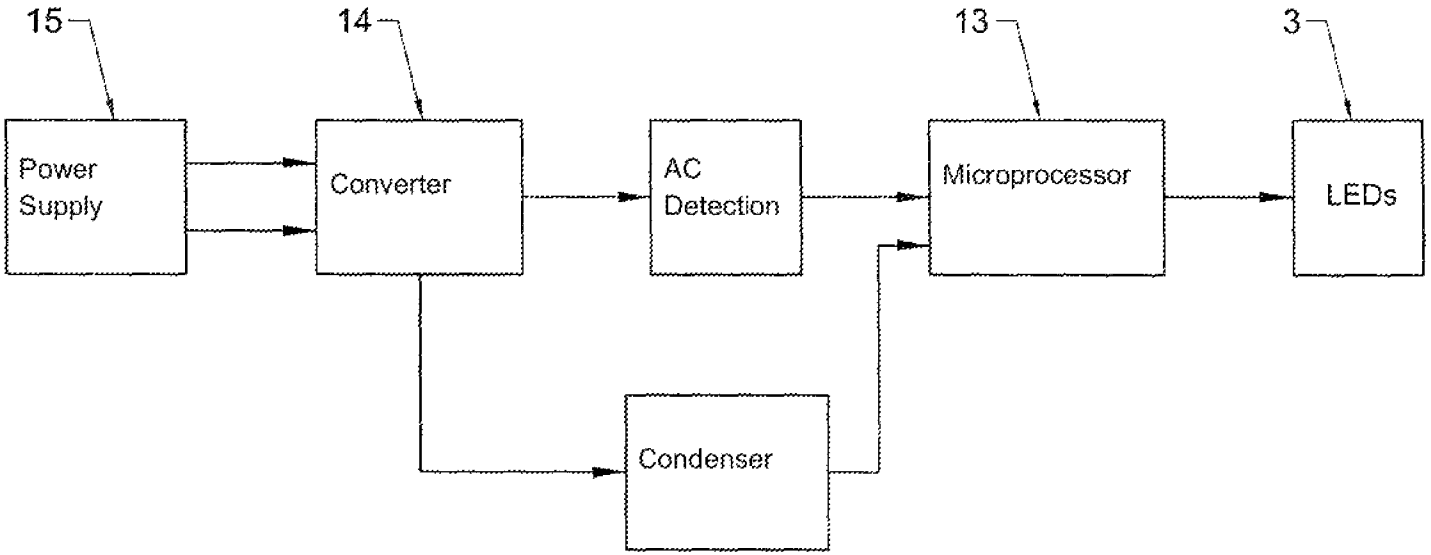
FIG. 4 is a schematic illustration of the operating principle of the circuit of an embedded detector for spotlights according to the invention.

FIG. 1 illustrates schematically an installation implementing the lighting device according to the invention. This lighting device 1 comprises primarily a plurality of spotlights 2 installed in the walls of a swimming pool P and featuring, each, one or several light sources constituted by a set of LEDs 3 (FIGS. 2 and 4) capable of emitting lights of different colors, said light source being connected to an electric power source (FIGS. 2, 3, and 4). The spotlights 2, in general, feature a watertight body to be installed in a swimming pool basin P and/or in proximity of the swimming pool P and they may present various shapes.

Lighting device 1 includes also at least one control box 4 located, generally speaking, away from the basin of the swimming pool P, on a building wall, for example, inside a residence. The control box 4 is also connected to the power source and controls the power supply to each of the spotlights 2.

This control box 4 is provided with keys 7, an antenna 6 for radio waves and a power disconnect 5.

According to an important characteristic arrangement of the invention, the disconnect 5 of the control box 4 is configured to transmit, over a shut-off element, advantageously consisting of a relay or triac, or any other shut-off system, IC command instructions capable of modifying the color of each of the LEDs 3 making up the LED 3 sets. The IC command instructions are transmitted to the spotlights 2 which are equipped with an embedded detector 8 described below and capable of interpreting this kind of IC instructions.

These IC command instructions present themselves in the form of combinations of power cuts for the purpose of changing the operating mode of a spotlight 2, or of a group of spotlights 2 or of all spotlights 2 at the same time.

To achieve this, the keys 7 installed, on the control box 4 allow the user to easily choose an operating mode of the spotlights 2 and, more specifically, to change the desired color for the lighting of the swimming pool P. More precisely, the keys 7 make it possible to select a combination of power cuts which effect the color change of the LEDs 3.

The disconnect 5 installed in the control box 4, according to the invention, features various electronic components known as such and in particular a microprocessor 9 which is configured to venerate a code constituted of combinations of short and long power cuts. These combinations of cuts are perceived as an interpretable message by the spotlights 2. Preferably, this disconnect 5 is mounted at the power source of the spotlights 2.

The cuts constituting the combinations are of a predetermined number and are of predetermined long and short lengths. These cuts are also sufficiently spaced to be detected and interpreted by the spotlights 2 with a low error rate.

The microprocessor 9 is coupled to a time base 10 of the disconnect 5 which allows it to perform these cuts with a precise duration within 1 ms. This time base may consist of an internal oscillator in the microprocessor 9 or of a quartz serving as oscillator.

The combinations of cuts thus form a Morse-like coding delivering information or instructions which correspond to the different operating, modes that the spotlights can adopt. In other words, it is the combination constituted by several short and long power cuts which is sent in a burst during a defined time which makes it possible to obtain the vocabulary of the device and to constitute a set of instructions.

The information is interpreted by the spotlights 2 when the burst is fully received.

This interesting characteristic of the invention provides several beneficial advantages, in particular the possibility of having a larger vocabulary but above all there is no error of detection or false interpretation by the device of the invention, of the coding consisting of the combination of short and long power cuts.

A combination of cuts presents, for example, a duration between 50 ms and 2 s.

Advantageously, the duration of a so-called "short" power interruption may vary between 100 and 300 ms and the duration of a so-called "long" power interruption may vary between 300 and 500 ms. However, the short cuts must be sufficiently long so they won't be mistaken for the frequent micro-outages occurring on power grids, whereas the long cuts must be sufficiently short so they won't cause the spotlights 2 to malfunction.

According to a variant of the implementation of the invention, the lighting device 1 can feature a remote control 11 communicating wirelessly with the control box 4. For that purpose, the latter is equipped with a radio receiver 12 intended to capture the information transmitted by this remote control 11, the latter being also equipped with keys T. This way the user can choose, remotely, the operating mode of the spotlights 2 and hence the desired color, wherever the user might be.

The spotlight 2, as described earlier, features one or several light sources constituted by a set of LEDs 3. These are generally high-powered LEDs 3 well known by the person skilled in the art.

According to an implementation of the invention, the light source is constituted by LEDs capable of emitting a single color, i.e., LEDs of white, red, green, blue or yellow, etc. This light source can also be constituted by LEDs 3 of different colors, generally red, green and blue, their combination of emissions allows for a very large variety of tints. It is also possible to use LEDs emitting each of the 3 base colors (red, green, and blue). These LEDs 3*a* are better known under the name of RGB LED (for Red/Green/Blue).

Advantageously, the LEDs 3 of a single color and/or the RGB LEDs are assembled on a single electronic board in the spotlight 2, this electronic board containing the electronic components of the spotlight 2. However, the LEDs 3 may be mounted on an electronic board that is different from the one provided for said components.

The embedded detector 8 installed on an electronic board known as such, in the spotlight 2, features a microprocessor 13 configured to interpret the IC command instructions sent by the cut-off device 5 of the control box 4. This microprocessor 13 includes a program constituted by the different possibilities of operating mode the spotlight can adopt in order to easily interpret the combinations of power cuts constituting the IC command instructions received; the microprocessor 13 modulates a signal allowing to change, for example, the color of the LEDs 3. The advantage of such an arrangement is precisely the simplicity of the detection of the messages sent by the emitter or cut-off device 5 reducing the errors of detection or of false interpretation.

The embedded detector 8 requires a DC power supply obtained through an alternating/direct rectifier or AC/DC converter 14, and which, by design, integrates a high-capacity condenser for filtering the alternating current.

This condenser provides a reserve of energy or memory which, during the power cuts intended to change the operating mode of the spotlights 2, enables, on the one hand, the embedded detector 8 to function for a few moments after said cuts, and, on the other hand, allows the spotlights 2 to remain powered for about 2 to 5 seconds. Of course, the capacity of the condenser makes it possible to vary the duration of its charge. Therefore, this memory can be achieved by any other adequate means known to the person skilled in the art.

Advantageously, and more precisely, in order to detect the power cuts, the embedded detector 8 has to monitor the presence of an alternating current and cut the power source of the LEDS 3 as early as possible, so as to preserve the energy reserve contained in the condenser. The detector 8 uses this accumulated energy to determine the time spent since the power cut. In other words, if the spotlight 2 is re-energized before the detector has exhausted the energy accumulated in the condenser, it is possible to determine the duration of the power interruption and to determine whether the cuts are long or short. Inversely, when the spotlight 2 is not repowered before the accumulated energy in the condenser is exhausted, the embedded detector 8 ceases to function. Repowering the spotlight 2 allows the embedded detector 8 to return to its previous state before the power cut.

Below is described an operating mode o f the device and the method according to the invention applied to an example of implementation according to which the lighting device consists of three spotlights 2 installed in a swimming pool P, a control box 4 and a radio wave remote control 11, these two elements being equipped with four keys 7, 7' which have the following functions:

Key 1: Run/Stop;

Key 2: Solid color/light plays;

Key 3: Previous;

Key 4: next.

The user presses key 1 to start the spotlights 2 and illuminate the swimming pool P, with the spotlights 2 turning on with the last color selected previously. The user can select the desired color by using keys 3 and 4. If he wishes the spotlights 2 to change colors automatically, according to the various sequences programmed into the spotlights 2, the user presses key 2, then selects the sequence that suits him by using keys 3 and 4. Just pressing key 1 is all he has to do to extinguish the spotlights. When the user restarts the spotlights 2 they will keep the last operating mode selected. There may be other operating modes, for example, diminishing or increasing the intensity of the light. By pressing successively keys 1 and 2, all spotlights 2 are reinitialized so that they will be returned to the same operating state. This arrangement allows re-synchronizing all spotlights 2 in the event that one of them had misinterpreted the transmitted IC command instruction.

This same device allows ordering the operating mode of a large number of spotlights 2, for example of about forty spotlights 2 spread out over a building facade and powered by the same power source.

The absence of additional cables and the sturdMess of the communication mode are particularly suitable for lighting sets that need to be synchronized and distributed over long distances.

The invention also concerns a lighting method, in particular for underwater lighting of the kind including be aforementioned characteristics.

According to the method of the invention, the control box 4 is provided with a cut-off device 5 configured for transmitting, via a cut-off element (for example consisting of a relay, triac or other cut-off system) IC command instructions in the form of short and long power cuts, or of combinations of such cuts, to spotlights 2 which are equipped with an embedded detector 8 configured so as to interpret said IC command instructions and capable of modifying the color of each of the LEDs 3 forming the LED 3 set.

According to an important characteristic of the method of the invention, an operating mode of the spotlight 2 is selected by using keys 7 of the control box 4, said operating modes being associated to IC command instructions.

According to another characteristic of the method of the invention, the IC command instructions are transmitted by the cut-off device 5 including a microprocessor 9 which generates a code consisting of combinations of short and long power cuts to modulate the colors of each of the LEDs 3. More specifically, this code, consisting of combinations of power cuts is sent to the embedded detector 8 of spotlights 2 and which is equipped with a microprocessor 13 which interprets said code and modulates a signal intended to modify the operating mode of said spotlights 2.

According to this method, the cut-off device 5, and more precisely the microprocessor 9, generates combinations of short and long power cuts.

Advantageously, the microprocessor 13 of the embedded detector 8 is programmed with the different operating modes of the spotlights 2 so as to interpret said IC command instructions transmitted by the microprocessor 9 of the cut-off device 5 and to modulate a signal capable of modifying the color of each of the LEDs 3 of the LED 3 set.

According to another characteristic arrangement of the method and the device of the invention, the cut-off system 5 can be configured to also transmit to the spotlights 2 parameters with values proportional to the duration of the cuts.

These transmitted values can make it possible, for example, according to an interesting application, to remotely adjust the luminous intensity of the spotlights 2 or to modify the speed of color changes or any other parameter of the operation of the spotlights which could then be memorized by the latter.

For example, a parameter with a value between 0 and 99 can be transmitted to the spotlights by the cut-off device through a power cut between 10 ms and 1 s. The microprocessor 13 of the embedded detector being programmed to interpret the cut in such a manner that the parameter is incremented by one unit of 10 ms. In this example, a cut lasting 600 ms would be interpreted by the detector 8 as an instruction to set said parameter at 59%.

The invention claimed is:

1. An underwater lighting device comprising:

a source of electric power;

a plurality of spotlights each having at least one light source having a set of LEDs, said set of LEDs adapted to emit light of different colors, said plurality of spotlights being connected to said source of electric power; and at least one control box connected to said source of electric power and communicating with each of said plurality of spotlights, the control box having a cut-off device transmitting IC command instructions to said plurality of spotlights via a current switching device, said plurality of spotlights equipped with an embedded detector that has a microprocessor, said embedded detector interpreting the IC command instructions and modulating a signal that modifies the color of each of said set of LEDs, the IC command instructions emitted by cut-off device being transmitted in code form having combinations of short power cuts and long power cuts, said short power cuts having a duration of between 100 milliseconds and 300 milliseconds, said long power cuts having a duration of between 300 milliseconds and 500 milliseconds.

2. The underwater lighting device of claim 1, said cut-off device having another mircroprocessor coupled to a time base that produces power cuts of a set duration.

3. The underwater lighting device of claim 1, said current switching device comprising a relay.

4. The underwater lighting device of claim 1, said current switching device comprising a triac.

5. The underwater lighting device of claim 1, each LED of said set of LEDs emitting a single color.

6. The underwater lighting device of claim 1, each LED of said set of LEDs selectively emitting a plurality of colors.

7. The underwater lighting device of claim 1, the control box having keys, said keys adapted to select an operating mode of said plurality of spotlights relative to said IC command instructions.

8. The underwater lighting device of claim 1, said cut-off device configured to generate combinations of short power cuts and long power cuts.

9. The underwater lighting device of claim 1, further comprising:

a remote control communicating wirelessly with the control box, the control box having a radio receiver, said radio receiver having an antenna.

10. The underwater lighting device of claim 1, said microprocessor having a program that has different operating modes for interpreting said IC command instructions and for modulating a signal that modifies the color of each LED of said set of LEDs.

11. An underwater lighting system comprising:

an electric power source;

a plurality of spotlights each having at least one light source, the light source having a set of LEDs capable of emitting light of different colors, said plurality of spotlights connected to said electric power source;

at least one control box connected to said electric power source and communicating with each of said plurality of spotlights, the control box having a cut-off device, said cut-off device having a microprocessor configured to generate a code that has short power cuts and long power cuts or combinations of the short power cuts and the long power cuts, said short power cuts having a duration of between 100 milliseconds and 300 milliseconds, said long power cuts having a duration of between 300 milliseconds and 500 milliseconds, said cut-off device having a current switching device that transmits IC command instructions by an antenna so as to modify the color of each LED of said set of LEDs, said plurality of spotlights equipped with in an embedded detector, said embedded detector having another microprocessor that interprets the IC command instructions.

12. The underwater lighting system of claim 11, the control box having keys that control an operating mode of said plurality of spotlights relative to the IC command instructions.

13. The underwater lighting system of claim 11, said code generated by said microprocessor being interpreted by said another microprocessor of said embedded detector so as to measure a duration of said short power cuts and long power cuts so as to modulate a signal that modifies an operation mode of said plurality of spotlights.

14. The underwater lighting system of claim 11, said microprocessor of said cut-off device generating combinations of short power cuts and long power cuts.

15. The underwater lighting system of claim 11, said another microprocessor of said embedded detector being programmed with the different modes of said plurality of spotlights so as to interpret the IC command instructions transmitted by said microprocessor of said cut-off device and to modulate a signal capable of modifying the color of each LED of said set of LEDs.

16. The underwater lighting system of claim 11, said cut-off device adapted to transmit values of parameters that are proportional to a duration of the long power cuts and the short power cuts so as to adjust a luminous intensity of said plurality of spotlights or to modify a speed of color changes of said set of LEDs.

* * * * *